United States Patent [19]

Saito et al.

[11] Patent Number: 4,587,536

[45] Date of Patent: May 6, 1986

[54] IMAGE RECORDING APPARATUS WITH COLOR DETECTION

[75] Inventors: Jun Saito, Kawasaki; Yuji Takahashi, Tokyo, both of Japan

[73] Assignee: Canon Kabushiki Kaisha, Tokyo, Japan

[21] Appl. No.: 645,084

[22] Filed: Aug. 28, 1984

[30] Foreign Application Priority Data

Sep. 5, 1983 [JP] Japan ..... 58-162068

[51] Int. Cl.[4] ..... G03G 15/2

[52] U.S. Cl. ..... 346/160; 346/157; 355/4

[58] Field of Search ..... 346/108, 157, 160, 74.7; 358/75, 78, 300-302; 355/4, 14 E

[56] References Cited

U.S. PATENT DOCUMENTS 3,861,305 1/1975 Sasaki ..... 101/336
4,432,634 2/1984 Tabuchi ..... 346/160 X
4,476,486 10/1984 Ayata et al. ..... 358/78

FOREIGN PATENT DOCUMENTS 57-176069 10/1982 Japan ..... 355/4
57-200054 12/1982 Japan ..... 355/14 E

*Primary Examiner*—E. A. Goldberg
*Assistant Examiner*—A. Evans
*Attorney, Agent, or Firm*—Fitzpatrick, Cella, Harper & Scinto

[57] ABSTRACT

An image recording apparatus with plural recording units each for recording in a different color, includes corresponding color detecting units for identifying the colors of the information to be recorded by each recording unit, thus effectively controlling the recording units. The apparatus includes a central processing unit and a selection circuit. The central processing unit is responsive to the output of the detecting units to control the selection circuit in order to conduct data of each of the different colors to the appropriate recording unit adapted to record in the corresponding color.

15 Claims, 6 Drawing Figures

IMAGE RECORDING APPARATUS WITH COLOR DETECTION

BACKGROUND OF THE INVENTION

1. Field of the Invention

The present invention relates to an image recording apparatus provided with plural image forming units, and more particularly to such image recording apparatus capable of selecting output image data or controlling the image forming conditions according to color information.

2. Description of the Prior Art

In conventional image recording apparatus with a single image forming unit, the image developing unit needs only to be mounted at a predetermined position. However, in an image forming apparatus with plural image forming units, it becomes necessary to identify the color of the developer in the developing station in each image forming unit. Particularly in case of superposed multi-color printing with plural image forming units, it is required to detect the color of the developer in each image forming unit, to send image data of the corresponding color to the corresponding image forming unit and to control the process with the developing condition etc. corresponding to the developer of said color. However, the conventional apparatus can only perform multi-colored printing in a fixed manner since the color of the developer of each image forming unit mounted on the apparatus cannot be identified.

SUMMARY OF THE INVENTION

In consideration of the foregoing, an object of the present invention is to provide an improved image recording apparatus.

Another object of the present invention is to provide an image recording apparatus capable of effectively utilizing plural image forming units.

Still another object of the present invention is to provide an image recording apparatus capable of controlling the recording operation and preventing erroneous operation by detecting the color information of image forming units.

Still another object of the present invention is to provide an image recording apparatus capable of comparing the color information of the image forming units with that of the recording data, thereby skipping an image forming unit corresponding to a color not required for recording and reducing the load on the image forming units.

The foregoing and still other objects of the present invention will become fully apparent from the following description.

DETAILED DESCRIPTION OF THE PREFERRED EMBODIMENTS

Now the present invention will be explained in detail with reference to the preferred embodiments shown in the attached drawings.

Figure 1:
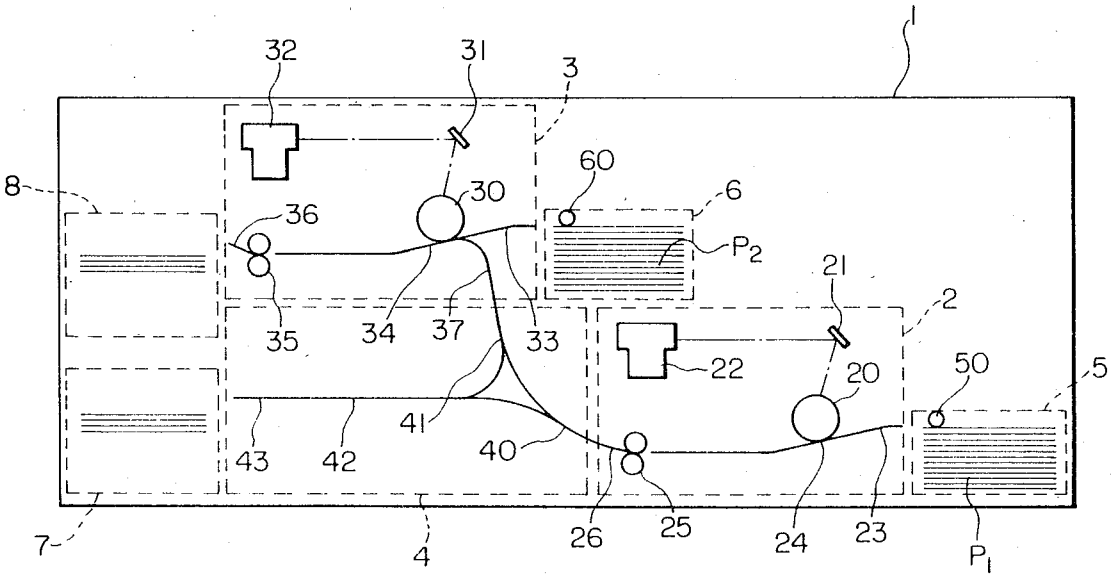
FIG. 1 is a cross-sectional view of an image recording apparatus provided with two image forming units.

FIG. 1 shows the internal structure of an image recording apparatus of the present invention, wherein a main body 1 of the image recording apparatus is provided with a first image forming unit 2; a second image forming unit 3; a sheet handling unit 4; a first sheet feed unit 5; a second sheet feed unit 6; a first stacker 7 and a second stacker 8. There are further shown photosensitive members 20, 30; mirrors 21, 31; beam scanning units 22, 32; sheet entrance transport units 23, 33; image transfer units 24, 34; sheet discharge rollers 26, 36; a sheet entrance transport unit 37; a sheet entrance unit 40; a sheet exit unit 41; transport paths 42, 43; sheet feed rollers 50, 60; and sheets P1, P2 stacked respectively in the first and second sheet feed units 5, 6.

The first and second image forming units 2, 3 are laser beam printers of substantially the same structure, in which known electrophotographic process units are positioned, as will be explained in relation to FIG. 2, around the photosensitive members 20, 30. Thus a multi-colored print can be obtained by providing the first image forming unit 2 with a developing station containing black developer and providing the second image forming unit 3 with a developing station containing red developer. In the multi-colored printing with such laser beam printers, the order of color printings need not be determined in advance, since such printings are generally used for example for printing the form and characters of a chart respectively in different colors and faithful color reproduction by color superposition is generally not required. Consequently the final image quality remains substantially same if the multi-colored printing is conducted by providing the first image forming unit 2 with the developing station containing red developer and providing the second image forming unit 3 with the developing station containing black developer. In such case each image forming unit has naturally to conduct process control corresponding to the respective color.

Figure 2:
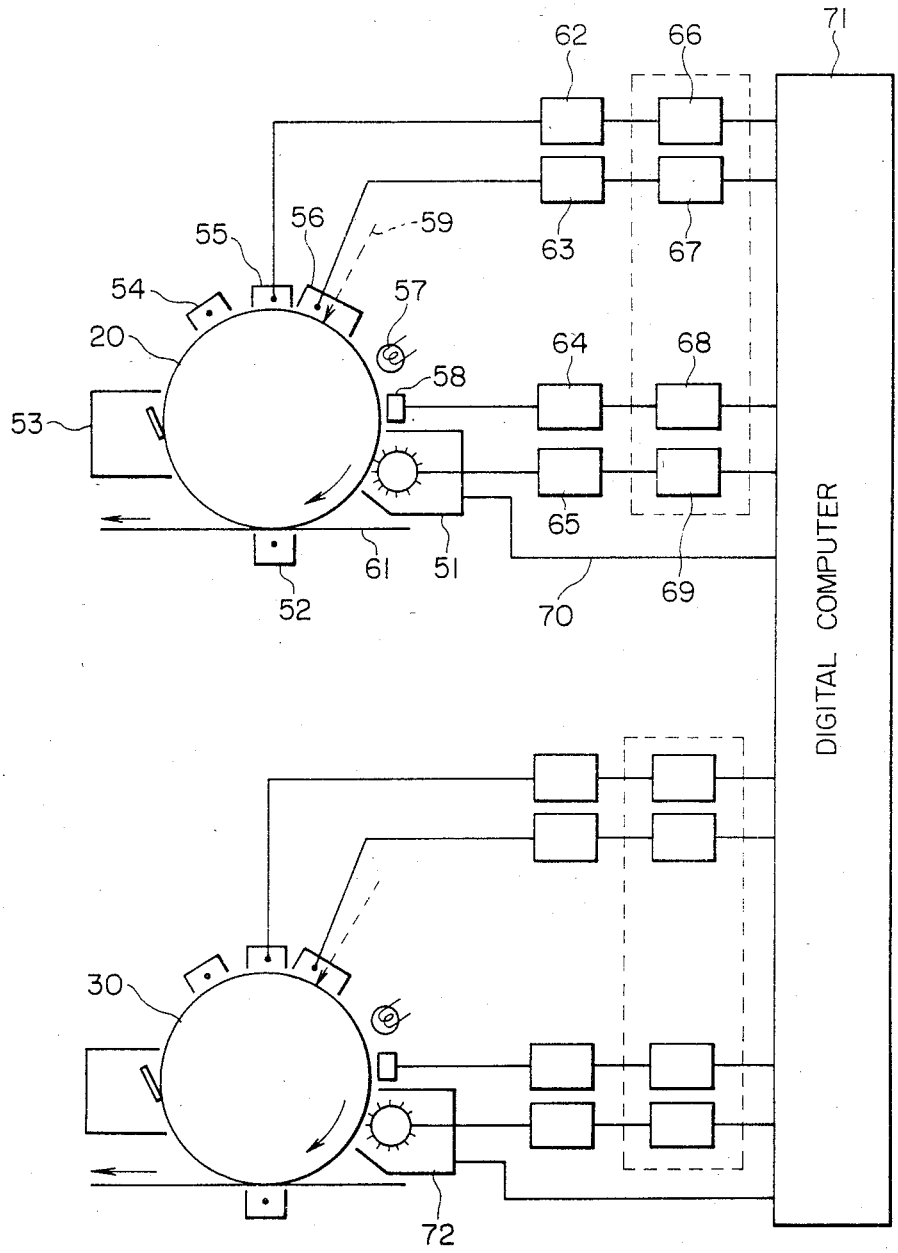
FIG. 2 is a block diagram, with a partial cross-sectional view, of the structure around the photosensitive members in the apparatus shown in FIG. 1.

FIG. 2 shows an example of the structure around the photosensitive member in the first and second image forming units, wherein shown are a developing station 51; a transfer charger 52; a cleaner 53; chargers 54–56; an exposure lamp 57; an exposure beam 59; a surface potential sensor 58; a path 61 for a recording sheet advancing in the direction of arrow; high voltage power sources 62, 63; a potential meter 64 provided in the main body; a bias voltage source 65; digital-to-analog (D/A) converters 66, 67, 69; an analog-to-digital (A/D) converter 68; and an information signal cable 70 for transmitting color information signal indicating the color of the developer contained in the developing station 51. The above-described components constitute the first image forming unit 2, but the second image forming unit 3 has an identical structure. There are further shown a digital computer 71 for process control of the image formation in the first and second image forming units 2, 3 for example for control of the surface potential, developing bias etc. and also for other processes such as image data selection; and a developing station 72 for the second image forming unit 3.

The photosensitive drum 20 is positively or negatively charged by the primary charger 55 after electrostatic cleaning by charge elimination with the charger 54, and is exposed to a light beam 59 from the beam scanning unit 22, simultaneously with AC charge elimination or DC charge elimination of a polarity opposite to that of the primary charging by means of the secondary charger 56. Thereafter the drum is exposed uniformly to the light of the exposure lamp 57 to form an electrostatic latent image of an elevated contrast. The electrostatic latent image is then developed into a visible toner image in the developing station 51.

On the other hand, a sheet supplied from the first sheet feed unit 5 is transported toward the photosensitive drum 20 at a determined timing, and receives the transfer of the toner image from the photosensitive drum 20 during passage between the transfer charger 52 and said photosensitive drum 20.

After the image transfer, the sheet is guided to an unrepresented fixing station for fixing the image by heat or pressure, and is discharged from the first image forming unit 2.

On the other hand, after the image transfer, the photosensitive drum 20 is cleaned by a cleaner 53 composed of an elastic blade, and proceeds through a succeeding imaging cycle.

The surface potential sensor 58 is positioned close to the surface of the photosensitive drum 20 between the lamp 57 and the developing station 51. The signal from said surface potential sensor 58 is supplied, after conversion into a digital signal in the A/D converter, to the digital computer 71. The detection signal from the surface potential sensor 58 is processed in a determined manner in the digital computer 71, and the result of said processing is supplied to the high voltage power sources 62, 63 to optimize the output powers of the primary and secondary chargings according to the color.

Said surface potential control is achieved, prior to the afore mentioned recording cycle, by forming a pattern containing a light area and a dark area on the photosensitive drum 20, detecting potentials corresponding to said light and dark areas by means of the surface potential sensor 58, and controlling the output powers of the primary and secondary chargers through the digital computer 71 in such a manner that the detected values approach target values of the light and dark potentials, which are determined for each color.

Said control is conducted at a suitable time, for example at the start of power supply and at the start of image recording operation.

The digital computer 71 is also connected to the bias voltage source 65 through the D/A converter 69, in order to switch the developing bias voltage according to the color information of the developing station supplied through the signal cable 70. The developing bias voltages are stored for different colors in a RAM 105 (FIG. 4) and are read according to the color information of the developing station. In case an AC voltage is supplied as the developing bias, the frequency of the DC component is regulated according to the color.

Said developing bias control may also be conducted according to the output of the surface potential sensor 58.

Figure 3A:
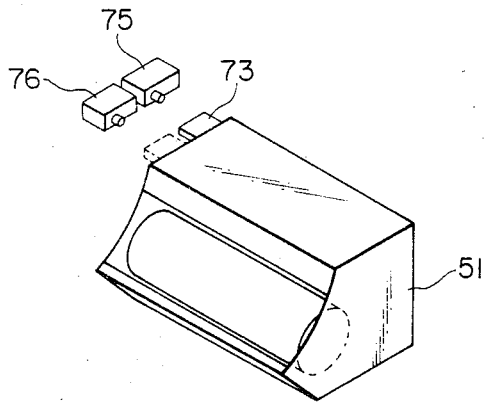
FIGS. 3A and 3B are perspective views showing examples of color information detecting means to be employed in the developing stations in the apparatus shown in FIG. 2.
Figure 3B:
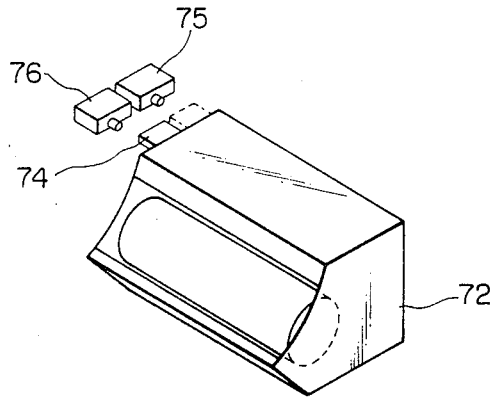

FIGS. 3A and 3B show examples of the structure of the developing station shown in FIG. 2. As an example the developing station 51 containing red developer is provided with a detection dog 73 protruding at the back thereof while the developing station 72 containing black developer is provided with a similar detection dog 74 at the front thereof. Said detection dogs 73, 74 are so positioned as to respectively activate microswitches 75, 76 when said developing stations 51, 72 are mounted in each image forming unit 2 or 3. Thus, as shown in Table 1, the color of the developer is identified as red when the microswitches 75, 76 respectively provide H(high)- and L(low)-level signals, and is identified as black in the opposite case. Also in case of using developers of three colors, the third color can be identified by the presence of both dogs 73, 74 to provide H-level signals from the microswitches 75, 76. No color is assigned to the case where the microswitches 75, 76 provide L-level signals since said case may be identified as the absence of the developing station or the erroneous mounting of the developing station. In this manner the use of two detectors 75, 76 allows identification of $2^2-1=3$ colors, and the use of three detectors allows identification of $2^3-1=7$ colors.

TABLE 1

| Color of developer | Signal level of microswitch 75 | Signal level of microswitch 76 |
|---|---|---|
| Red | H | L |
| Black | L | H |
| (third color) | H | H |
| (not used) | L | L |

Figure 4:
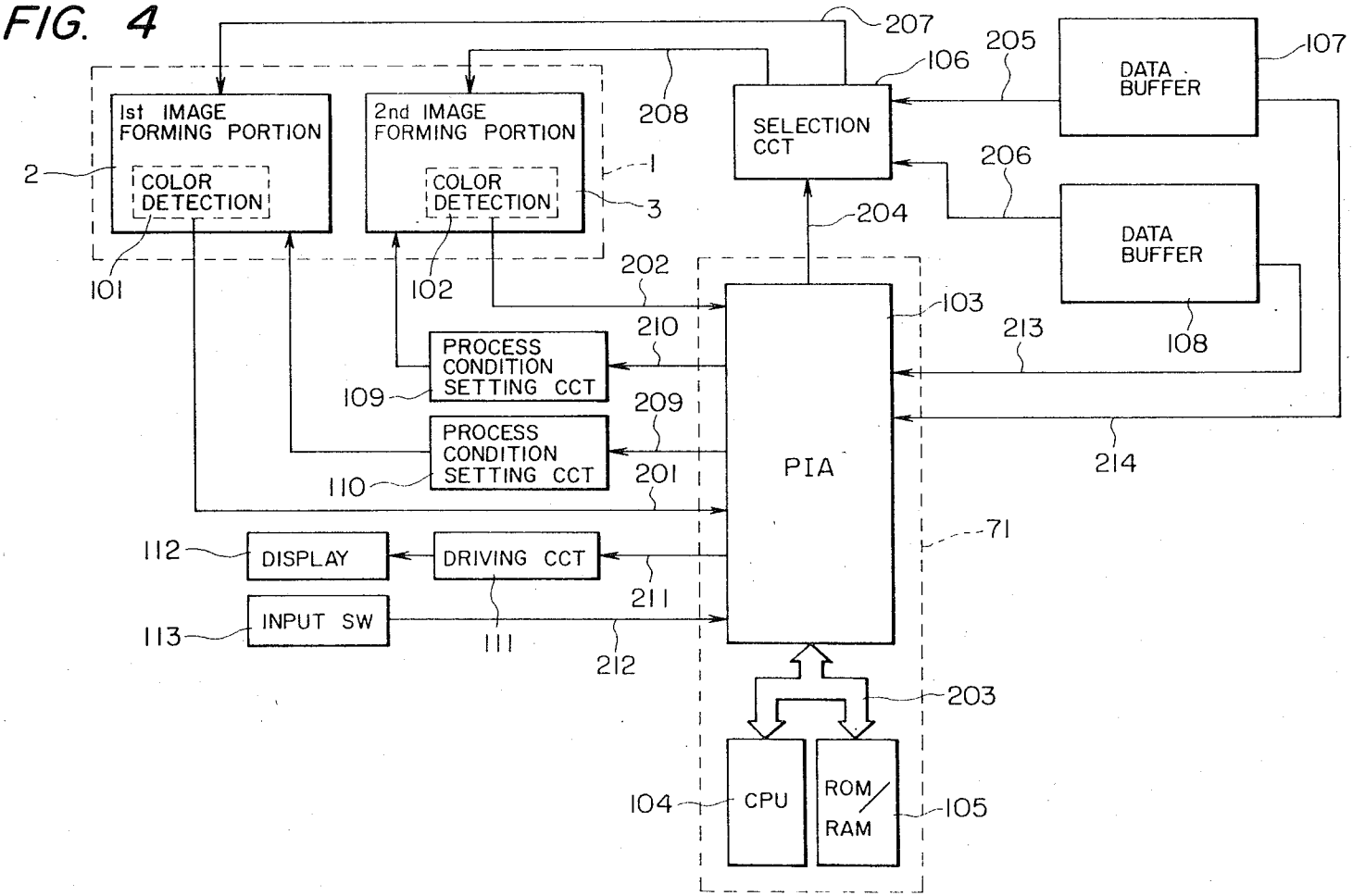
FIG. 4 is a block diagram showing an example of the control unit shown in FIG. 2.

FIG. 4 shows an example of the control unit for the image recording apparatus of the present invention provided with two image forming units as shown in FIG. 2, wherein shown are a color detection unit 101 for detecting the color information of the developer in the first image forming unit 2 and a color detection unit 102 for detectomg the color information of the developer in the second image forming unit 3. Output signals 201, 202 from said detection units 101, 102 are supplied to a peripheral interface adapter (PIA) 103, which is connected, through a bus 203, to a central processing unit (CPU) 104, a read-only memory (ROM) storing the control program and a random access memory (RAM) 105.

Figure 5:
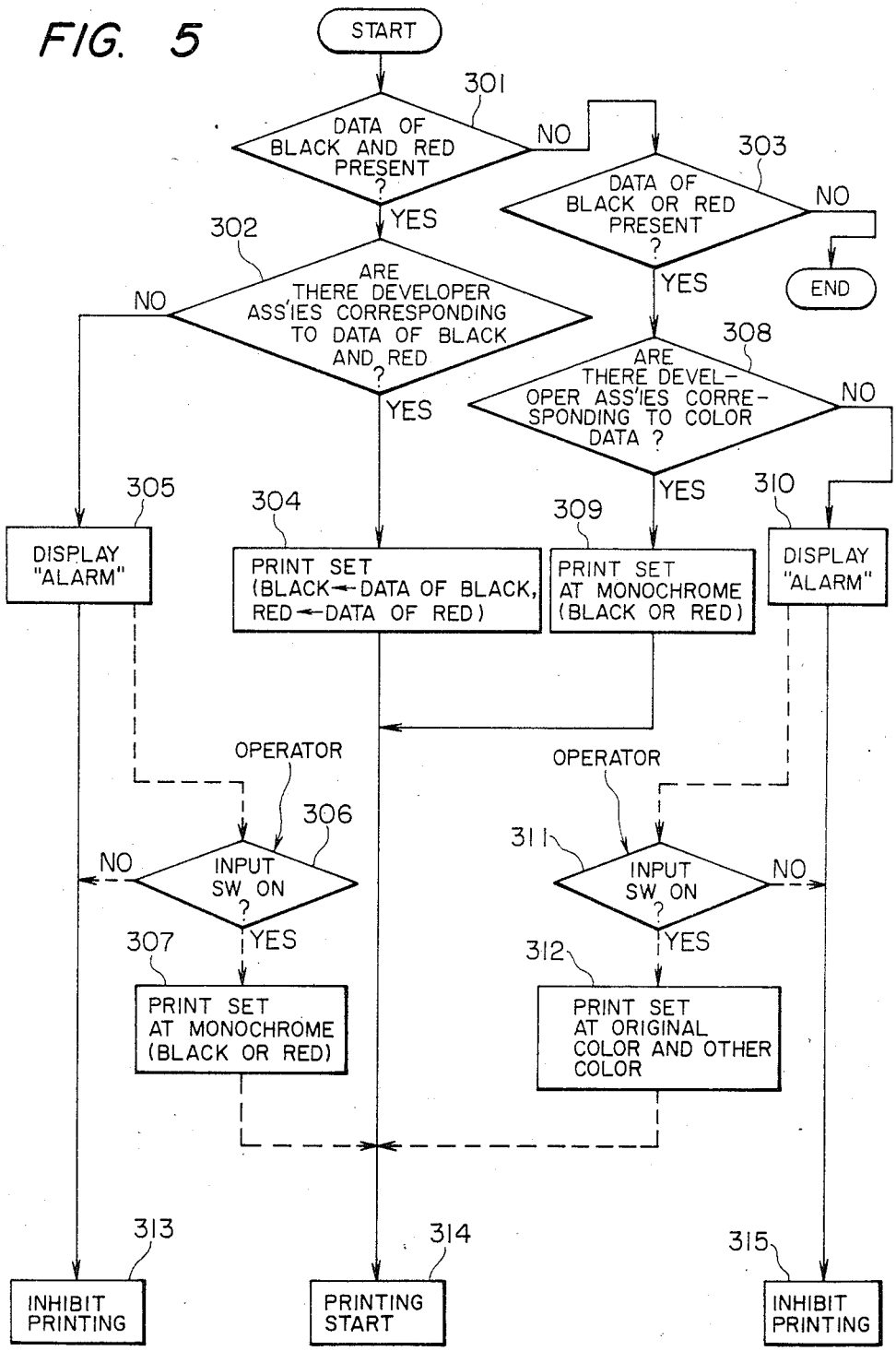
FIG. 5 is a flow chart showing the function thereof.

The detection signal 201 supplied from the detection unit 101 for detecting the color information of the first image forming unit 2 and the detection signal 202 from the detection unit 102 for detecting the color information of the second image forming unit 3, both supplied to the PIA 103 are processed in the CPU 104 according to the procedure shown in FIG. 5, and the PIA 103 supplies the selection circuit 106 with a data selection signal 204 corresponding to said detection signals, whereby said selecting circuit 106 supplies the image forming units 2, 3 with data 207, 208 corresponding to data 205, 206 from data buffers 107, 108. At the same time the PIA 103 provides the image forming units 2, 3 respectively with process control signals 209, 210 through respective process condition setting circuits 109, 110, thus performing image printing of the corresponding colors in the first and second image forming units 2, 3.

Said processing condition setting circuits 109, 110 comprise high voltage power sources 62, 63, a potential meter 64, a bias voltage source 65, D/A converters 66, 67, 69 and an A/D converter 68 shown in FIG. 2.

Also, in case the printing operation is prohibited under a certain condition according to the control procedure shown in FIG. 5 to be explained later, a warning signal 211 from the PIA 103 is supplied to a driving circuit 111 to provide a warning display on a display unit 112, and, in such case, the prohibition may be cancelled through the PIA 103 by a signal 212 from an external input switch 113.

The afore mentioned data buffers 107, 108 store respectively print data for different colors, for example the data to be printed black are stored in the data buffer 107 while the data to be printed red are stored in the data buffer 108. Said data buffers 107, 108 provide the PIA 103 with signals 213, 214 indicating the presence or absence of data in said data buffers 107, 108.

Now reference is made to FIG. 5 for explaining the function of the apparatus of the present invention shown in FIG. 4.

At first a step 301 identifies the presence of data (for example black and red) in the data buffers 107, 108 through signals 213, 214, and the program proceeds to a step 302 in the presence of both data or to a step 303 in the absence of either data. The step 302 identifies the mounting of the black and red developing stations 51, 72 through signals 201, 202 from the detection units 101, 102, and the program proceeds to a step 304 in the presence of both developing stations 51, 72 thus suppling black data 205 to an image forming unit (for example 3) provided with the black developing station 72 and red data 206 to an image forming unit (for example 2) provided with the red developing station 51 through the selecting circuit 106 and causing the process condition setting circuits 109, 110 to set process conditions for black and red image formations. In this manner the printing operation is started in a step 314.

In the event a developing station of a corresponding color is absent though black and red data are stored in the data buffers 107, 108, the step 302 provides a negative identification whereby the program proceeds to a step 305 to display a warning on the display unit 112, and the printing operation is prohibited in a step 313. However, if at least one of the black and red developing stations is mounted, the program proceeds from the step 305 for warning to a step 306, in which the operator may actuate an external input switch 113 to select, in a step 307, the selecting circuit 106 and the process condition setting circuit 109 or 110 for printing the black and red data in either black or red color. In such case the printing operation is started in the step 314.

In case the data are only in the black or red color, the program proceeds from the step 303 to the step 308, 309 for data printing in a single color (black or red), and, in such case, the image forming unit 2 or 3 not involved in the printing operation is skipped. On the other hand, in case the step 308 identifies the presenceof the developing station 51 or 72 of a color corresponding to the data, the program proceeds to a step 310 to display a warning on the display unit 112, and the printing operation is prohibited in a step 315. Also, if desirable, the program may proceed from the step 310 to a step 311 for data printing in a different color, by means of the actuation ofthe external input switch 113 in a step 311.

As explained in the foregoing, the present embodiment provides an image forming apparatus capable of multi-colored printing with plural image forming units, in which the detection of the color information of the developer in each developing station provides the advantages of:

(1) preventing erroneous operation by releasing a command for enabling or disabling printing operation by inspecting correspondence with the color of the data to be printed;

(2) enabling efficient use of plural image forming units, since each image forming unit need not be assigned to a particular color, and the multi-colored printing can be done by the supply of printing data according to the color of the developing station mounted in each image forming unit; and (3) reducing the load on the image forming units, in case of single-color printing in the course of multi-colored printing mode, by skipping the image forming units of other colors.

In the foregoing embodiment each of the plural image forming units is provided with a drum and a developing station, but there may also be employed an image recording apparatus in which plural developing stations are provided on a photosensitive drum and are selectively driven for superposed recordings on a same sheet.

In such case the color information of the selected developing station is to be compared with the color information of the image data, and the output sequence of the image data is to be controlled according to the result of said comparison.

Also in the foregoing embodiment there has been employed a laser printer, but a similar control with color detection is applicable also to other printers such as an ink jet printer or a thermal printer.

Also the recording data may be data supplied from a host computer or those supplied from an image reading device such as a charge-coupled device.

What we claim is:

1. An image recording apparatus for receiving input image data and for recording images on a recording material, said apparatus comprising:

first recording means for recording an image on a recording material based input image data, a color in which said first recording means records the image being selectable;

first detection means for detecting information indicating the color in which said first recording means records an image and for producing an output signal representing the detection;

second recording means for recording an image on a recording material based on input image data, a color in which said second recording means records the image being selectable;

second detection means for detecting information indicating the color in which said second recording means records an image and for producing an output signal representing the detection; and selecting means for selecting image data supplied to said first and second recording means in accordance with the output signals produced by said first and second detection means.

2. An image recording apparatus according to claim 1, wherein said selecting means comprises first and second memory means for storing image data including different color information, and comparator means for comparing the output signals produced by said first and second detection means with color information of image data stored in said first and second memory means, said selecting means supplying said first and second recording means respectively with image data corresponding to the output signals produced by said first and second detection means in response to the output of said comparator means.

3. An image recording apparatus according to claim 2, wherein said selecting means comprises alarm means for providing a warning in the absence of detection of coincidence in the comparison by said comparator means.

4. An image recording apparatus according to claim 3, wherein said selecting means comprises instruction means for supplying the image data to one of said first and said second recording means even in case of absence of detection of coincidence in the comparison by said comparator means.

5. An image recording apparatus according to claim 1, wherein each of said first and second recording means comprises latent image forming means for forming an electrostatic latent image on a recording member and a developing means for developing said latent image into a visible image.

6. An image recording apparatus according to claim 5, wherein said first and second detection means are adapted to detect information corresponding to the colors of the developer in said developing means.

7. An image recording apparatus according to claim 5, further comprising laser means for producing a laser beam for exposing said latent image forming means and wherein said latent image forming means is adapted to form the electrostatic latent image on said recording member corresponding to input image data by turning on and off said laser means.

8. An image recording apparatus for receiving input image data and for recording images on a recording material, said apparatus comprising:

first recording means for recording an image on a recording material based on input image data, a color in which said first recording means records the image being selectable;

first detection means for detecting color information indicating the color in which said first recording means records an image;

second recording means for recording an image on a recording material based on input image data, a color in which said second recording means records the image being selectable;

second detection means for detecting color information indicating the color in which said second recording means records an image; and control means for comparing the color information detected by said first and said second detection means with color information representing input image data in accordance with which an image is to be recorded, and for selectively driving one of said first and said second recording means in coincidence with color information representing input image data in accordance with which an image is to be recorded.

9. An image recording apparatus according to claim 8, wherein said control means is adapted to control the transportation of the recording material in order to skip the one of said first and said second recording means not required in the recording operation.

10. An image recording apparatus for receiving input image data and for recording images on a recording material, said apparatus comprising:

recording means for recording an image on a recording material based in input image data, a color in which said recording means records the image being selectable;

detection means for detecting color information representing the color in which said recording means is adapted to record;

prohibiting means for comparing the color information detected by said detection means with the color of said input image data, and prohibiting the recording operation of said recording means in case no coincidence is determined in said comparsion; and cancelling means for cancelling the prohibiting operation of said prohibiting means, said cancelling means being adapted to enable recording operation by said recording means even when the color information detected by said detection means does not coincide with the color of the input image data as determined by said prohibiting means.

11. An image recording apparatus according to claim 10, wherein said cancelling means includes switch means and is adapted to cancel said prohibiting operation by actuation of switching means.

12. An image recording apparatus for receiving input image data and for recording images on a recording material, said apparatus comprising:

recording means for recording an image in a first color on a first surface of a recording material based on input image data, said recording means further being operable, after completion of image recbrding on the recording material in the first color, to record an image on the first surface of the recording material in a second color different from the first color, the first and second colors being selectable;

detection means for detecting color information relating to the recording operation of said recording means; and selecting means for selecting image data to be supplied to said recording means in accordance with the color information detected by said detection means.

13. An image recording apparatus according to claim 12, wherein said recording means comprises first recording means for image recording with a first color and second recording means for image recording with a second color, and said detection means comprises first detection means for detecting color information corresponding to said first color and second detection means for detecting color information corresponding to said second color.

14. An image recording apparatus according to claim 13, wherein said selecting means is adapted to select image data supplied to said first and second recording means according to color information detected by said first and second detection means.

15. An image recording apparatus for receiving input image data and for recording images on a recording material, said apparatus comprising:

first recording means for recording an image on a recording material based in input image data, a color in which said first recording means records the image being selectable;

detection means for detecting information indicating the color in which said first recording means records an image;

second recording means for recording an image on a recording material based on input image data; and selecting means for selecting image data supplied to said first recording means in accordance with the output signals from said detection means.

* * * * *

UNITED STATES PATENT AND TRADEMARK OFFICE

CERTIFICATE OF CORRECTION

PATENT NO. : 4,587,536
DATED : May 6, 1986
INVENTOR(S) : Jun SAITO, ET AL.

It is certified that error appears in the above-identified patent and that said Letters Patent is hereby corrected as shown below:

Column 1

Line 21, change "multi-color" to --multicolor-- and
Line 28, change "multi-colored" to --multicolored--.

Column 2

Lines 25-26, change "multi-colored" to --multicolored--;
Line 30, change "multi-colored" to --multicolored;
Line 37, change "multi-colored" to --multicolored; and
Line 62, change "3 for" to --3, for--.

Column 3

Line 37, change "afore mentioned" to --aforementioned--.

Column 4

Line 4, change "1, the" to --1 below, the--; and
Line 32, change "detectomg" to --detecting--.

UNITED STATES PATENT AND TRADEMARK OFFICE

CERTIFICATE OF CORRECTION

PATENT NO. : 4,587,536
DATED : May 6, 1986
INVENTOR(S) : Jun SAITO, ET AL.

It is certified that error appears in the above-identified patent and that said Letters Patent is hereby corrected as shown below:

Column 5

Line 3, change "afore mentioned" to --aforementioned--;
Line 42, change "color" to --color--;
Line 49, change "presenceof" to --presence of--;
Line 56, change "ofthe" to --of the--; and
Line 59, change "multi-colored" to --multicolored--.

Column 6

Lines 1-2, change "multi-colored" to --multicolored--;
Lines 6-7, change "multi-colored" to --multicolored--; and
Line 32, change "based input" to --based on input--.

UNITED STATES PATENT AND TRADEMARK OFFICE

CERTIFICATE OF CORRECTION

PATENT NO. : 4,587,536

DATED : May 6, 1986

INVENTOR(S) : Jun SAITO, ET AL.

It is certified that error appears in the above-identified patent and that said Letters Patent is hereby corrected as shown below:

Column 7

Line 61, change "based in input" to --based on input--.

Column 8

Line 25, change "recbrding" to --recording--; and

Line 55; change "based in input" to --based on input--.

Signed and Sealed this

Fourteenth Day of April, 1987

*Attest:*

DONALD J. QUIGG

*Attesting Officer*

*Commissioner of Patents and Trademarks*